United States Patent [19]

Gerber

[11] Patent Number: 4,949,699

[45] Date of Patent: Aug. 21, 1990

[54] ARROW GUIDE

[75] Inventor: Eugene A. Gerber, Pottstown, Pa.

[73] Assignee: Product Innovation Corp., Pottstown, Pa.

[21] Appl. No.: 316,520

[22] Filed: Feb. 28, 1989

[51] Int. Cl.[5] ..... F41B 5/00

[52] U.S. Cl. ..... 124/44.5; 124/24.1

[58] Field of Search ..... 124/41 A, 24 R, 25, 124/88

[56] References Cited

U.S. PATENT DOCUMENTS

| | | | |
|---|---|---|---|
| 2,483,928 | 10/1949 | Ott | 124/41 A |
| 3,158,145 | 11/1964 | Handy | 124/41 A |
| 3,504,659 | 4/1970 | Babington | 124/41 A X |
| 4,318,390 | 3/1982 | Trotter | 124/41 A |
| 4,407,261 | 10/1983 | Elliott | 124/41 A |
| 4,632,087 | 12/1986 | Cline | 124/41 A |
| 4,686,956 | 8/1987 | Tronscoso, Jr. | 124/41 A |
| 4,722,318 | 2/1988 | Yankey | 124/25 |

*Primary Examiner*—Peter M. Cuomo
*Attorney, Agent, or Firm*—Howson and Howson

[57] ABSTRACT

A guide device designed to hold an arrow on its rest under all conditions of hunting and shooting a bow is disclosed. The device is held to the bow by a screw through its mounting bracket and into the rest or berger button hole in the side of the bow. The guide device has two guide arms which hold the arrow in place and a trigger to open the arms when the archer is ready to shoot. A spring is attached to the arms for closing the arms and returning the trigger. The arms are also shaped on top to allow faster and easier arrow placement when loading. After loading an arrow, the arrow is held on the rest and is ready for shooting. After making a full draw of the bow, the trigger is pulled with the index finger and the arms move away to let the arrow pass freely. After the shot, the trigger is released and the spring closes the guide arms. The guide arms can be easily bent to accommodate shorter arrow shafts and front mounted bow sights.

6 Claims, 2 Drawing Sheets

FIG. 2
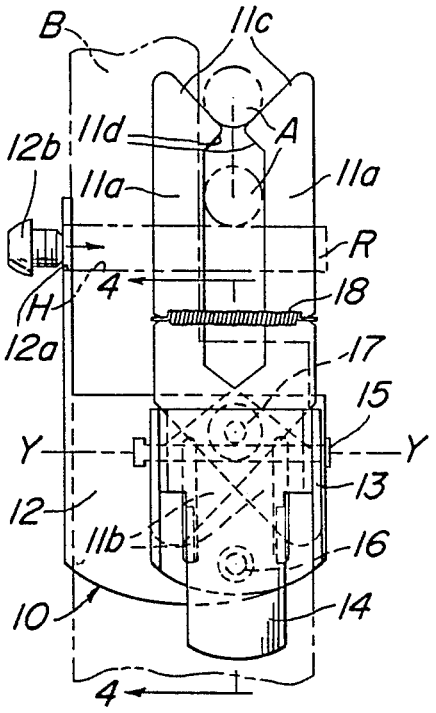
FIG. 3
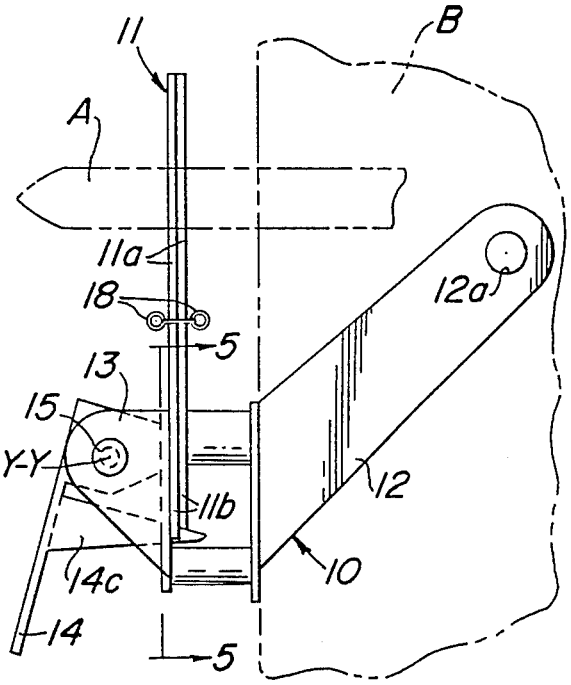
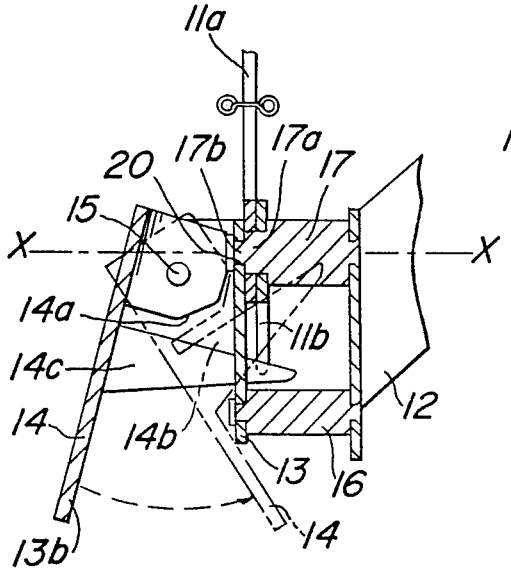
FIG. 4
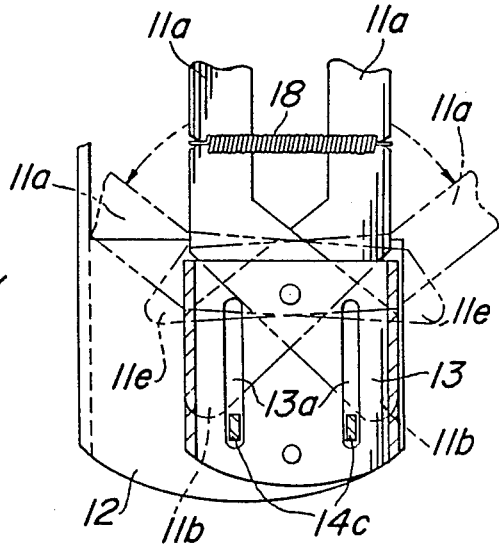
FIG. 5

ARROW GUIDE

BACKGROUND OF THE INVENTION

Discussion of Prior Art

Various devices have been proposed or developed for improving arrow control on a bow. One such device made of rubber requires the user to hook the arrow into place. Unfortunately, the rubber is continually stretched during use, therefore the device has a rather short useful life. Also, the rubber device does not continually guide the arrow during the draw of the bow. Thus, the rubber device offers arrow control for periods which are limited by arrow shaft movement. Furthermore, the rubber device is designed to retain the arrow on the arrow rest when the arrow is bumped. However, the rubber device is delicate and cannot hold the arrow at high shock levels.

Another arrow guide, made primarily of plastic, has an adhesive mounting surface. A primary disadvantage of the plastic device is the difficulty of mounting it to the bow properly. Moreover, the device applies downward pressure on the arrow rest. Thus, certain rests cannot be used because they would bend or break from the pressure. Another effect of downward pressure on the arrow rest is arrow deflection. Arrow deflection is an obstacle to the accuracy of the bow. Finally, the plastic device can block the sight line of the archer. Of course, the user must deviate from his established style of shooting.

Essentially, archers would prefer a sturdy device which maintains control of arrows conclusively.

SUMMARY OF THE INVENTION

Accordingly, it is an object of the present invention to provide a reliable device which will control every arrow placed on the bow, which is not difficult to operate, which is mounted easily on the bow, which allows the archer to manually control it's function, which is durable for years of useful service, which does not interfere with the normal operation of the arrow rest, and which can be used effectively with a majority of bows on the market.

Briefly, these and other objects and aspects of the invention are accomplished with an arrow guide which is formed to be supported from a bow adjacent to the arrow rest for holding an arrow in place ready for use. Two guide arms in front of the arrow rest are urged closed against opposite sides of the arrow by spring means. A finger-operated trigger at the bow grip enables the user to spread open the arms after making a full draw of the bow to let the arrow pass freely. The distal ends of the guide arms are flared to allow the arrow to spread the arms without operating the trigger.

Further objects and advantages of the invention will become apparent from a consideration of the accompanying drawings and ensuing description.

BRIEF DESCRIPTION OF THE DRAWINGS

FIG. 2 is a front elevation view of the arrow guide of FIGS. 1A and 1B;

FIG. 3 is a side elevation view of the arrow guide of FIGS. 1A and 1B;

FIG. 4 is a cross sectional view of the arrow guide taken along the line 4—4 of FIG. 2; and FIG. 5 is a cross sectional view of the arrow guide taken along the line 5—5 of FIG. 3.

DESCRIPTION OF THE PREFERRED EMBODIMENT

Figure 1A:
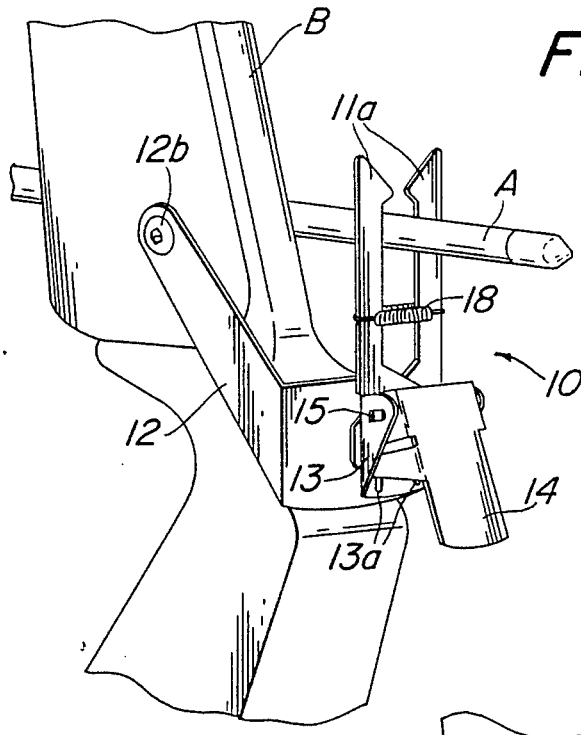
FIGS. 1A and 1B are isometric views of an arrow guide according to the invention mounted on a "righthand"bow in the normally closed position, and in the open position, respectively.
Figure 1B:
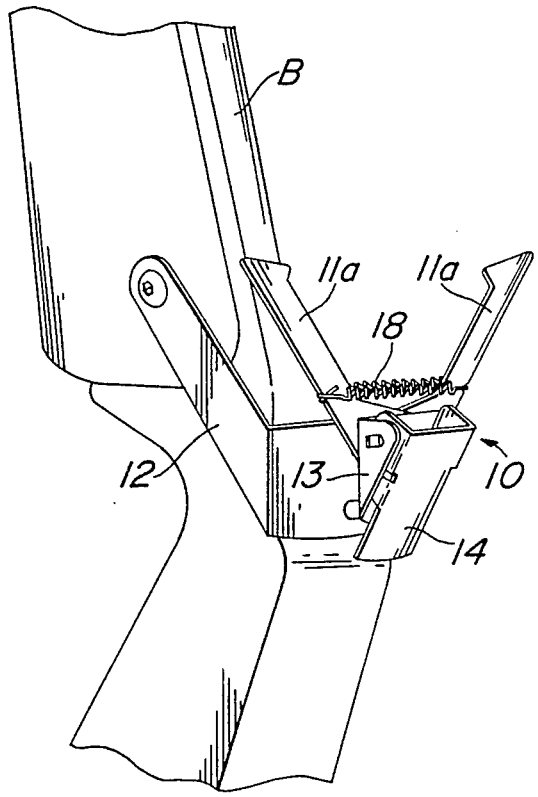

Referring now to the drawings wherein like characters designate like or corresponding parts throughout the several views, there is shown in FIGS. 1A and 1B an arrow guide 10 mounted on a bow B immediately above the bow handle. FIG. 1A shows an arrow A held on an arrow rest R along the line of sight.

The guide comprises a steel mounting bracket 12 having a large hole **12*a* used in conjunction with a screw 12*b*, or an existing rest assembly, not shown, to mount on the bow at a cushion hole or so-called "burger button" hole H. Bracket 12** is made of 1/16 inch thick cold or hot rolled steel and is cut and formed by progressive dies in a power press.

A spacer rivet 16 and a pivot rivet 17 provide the distance needed from the mounting bracket 12 to permit movement of a trigger 14. In addition, the pivot rivet 17 has two shoulders **17*a* and 17*b* at one end. The two shoulder end is opposite an upper hole 20 of bracket 12. The middle diameter acts as a pivot point for a pair of elongate guides 11 having first or upper arms 11*a* and second or lower arms 11*b* extending from the pivotal axis X—X. Note the position of the guides in FIG. 2. The large diameter of pivot rivet 17 in conjunction with the rear surface of a trigger support 13, confines the guide arms 11*a* and 11*b* to one axis X—X (FIG. 4) of movement. The small diameters at the ends of both rivets 16 and 17 are connected to the mounting bracket 12 and trigger support 13 as shown in FIG. 4. A punch press is used to expand the ends of the rivets in the connection process. The rivets are made of cold or hot rolled steel in rod form and are cut to size on an automatic lathe; and arms 11, trigger support 13 and trigger 14 are made of the same material and process as bracket 12**.

The trigger support 13 and a trigger pin 15 hold trigger 14 in place as shown in FIGS. 2 and 3. Slots **13*a* in trigger support 13 allow a pair of tynes 14 *c* of the trigger to come in contact with the bottom edges 11*e* of lower arms 11*b*. Trigger pin 15 has a head at one end and is pinched at the other end after it is inserted through the appropriate holes in trigger support 13 and trigger 14. The trigger pin 15 is steel and is preferably manufactured using the same processes as the rivets 16 and 17**.

Zinc plated 0.021 inch diameter carbon steel springs 18 hold guides 11 and trigger 14 in their natural position. Note that springs 18 are expansion springs and pull the guide arms **11*a* and 11*b* together above the pivot axis X—X. The trigger 14 holds the upper arms 11*a* in the normally closed position. The desired guide arm spacing is achieved by the shape of the rear edge 14*a* of trigger 14 as cut behind the trigger pin holes. The surface 13*b* of trigger support 13, which is adjacent to the surface 14*b* of each tyne 14 *c* contacts lower arms 11*b* and stops the trigger 14 as shown in FIG. 3**.

The entire guide is plated or otherwise coated to protect it from the causes of surface rust. Sound muting coatings are applied to the guide arms **11*a* and 11*b*** as needed.

Guide operation

Arrow guide 10 is designed to hold the arrow on the arrow rest at all times prior to shooting.

The mounting bracket 12 provides the point of connection to the bow B at the burger button hole H of the bow. Hole 12*a* of the mounting bracket 12 seats on the button hole H like a flat washer. Note that the guide 10 is mounted so trigger 14 and guide arms 11*a* and 11*b* are directly in front of the bow handle. It is preferred that the portion of the mounting bracket 12 which holds rivets 16 and 17, touches the front of the bow handle. The steel mounting bracket 12 can be bent accordingly to allow alignment of the guide for proper operation. Rivets 16 and 17 are stationary.

The guide arms 11*a* keep the arrow shaft from falling from the arrow rest R. The top edge 11*c* of each guide arm 11*a* flares outwardly on an angle. The angle facilitates placing the arrow A through the guide arms and onto the rest R. The inward ramps 11*d* directly above the inner parallel edges of the guide arms 11*a* and 11*b* hold the arrow A inside the guide arms should upward pressure be exerted on the arrow shaft. The steel guide arms can be bent back toward the mounting bracket 12 to accommodate different length arrow shafts when the bow is fully drawn. The bendable guide arms also accommodate front mounted sights.

The trigger support 13 in conjunction with trigger pin 15, provides a hinge at axis Y—Y for trigger 14. It also functions to limit trigger movement from the normally closed position to the open position. Furthermore, the trigger support 13 serves to keep the guides 11 on the middle diameter of pivot rivet 17.

The trigger 14 opens the guide arms 11*a* by applying upward pressure at contact points under the lower edges 11*e* of the guide arms 11*b* when it is pulled. In turn, the arrow fletchings or vanes can pass between the guide arms 11*a* and not touch them. Therefore, the arrow will fly without any deflection from normal flight.

Springs 18 hold the guide arms 11*a* and trigger 14 in the normally closed position. The springs provide the arrow retaining force of the guide. The springs absorb shock which is from time to time transferred from the arrow shaft to the guide arms. During operation of the guide 10, finger pressure overrides the retaining pressure of the springs resulting in the arms 11*a* as shown in FIG. 1B. Note the expanded springs 18.

Thus the specification reveals a durable and easily operated arrow guide that can sturdily hold the arrow on the bow at all times until the arrow is shot.

While the preceding description embodies many specificities, these should not be surmised as limitations on the scope of the invention, but rather an example of one preferred configuration thereof. Other variations are possible. For example, one variation could place the guide arms behind the bow handle. Another variation could use a single arm or element. Still another variation would use a rubber band or other means instead of two springs. Accordingly, the scope of the invention should be determined by the appended claims.

I claim:

1. An arrow guide for holding an arrow on an arrow rest of an archery bow comprising, in combination: support means formed to be attached to the bow adjacent to the arrow rest;

a pair of elongate members each pivotally connected to said support means for rotation in a plane generally normal to the line of sight of the arrow, and disposed on opposite sides of the arrow, said elongate members includes a pair of arms having oppositely inclined surfaces;

elastic means connected to said members for urging said members toward each other; and trigger means pivotally connected to said support means and operatively connected to said members for manually spreading said members apart from the arrow against the force of said elastic means for allowing the arrow to pass between said members without touching, said trigger means includes a pair of tynes slidably engaging respective ones of said inclined surfaces for translating rotation of said trigger means to rotation of said elongate members.

2. An arrow guide according to claim 1 wherein:

said arms further include flared surfaces at the distal ends for imparting a spreading force to said members when an arrow shaft is manually urged between said surfaces.

3. An arrow guide for attachment to an archery bow, comprising, in combination:

a support;

a pair of elongate members each pivotally connected on a first axis intermediate the ends thereof to said support for relative rotation toward and away from an arrow disposed along the line of sight, said members each having first and second arms extending from the pivotal connection, said first arms formed to grip the arrow shaft therebetween;

a spring connected to said first arms for urging said first arms toward the arrow shaft;

a pair of opposed inclined surfaces formed on said second arms; and a pair of tynes pivotally connected to said support on a second axis generally normal to the first axis and slidably engaging said inclined surfaces for moving said first arms apart against the force of said spring.

4. An arrow guide according to claim 3 wherein:

said first arms include generally parallel confronting surfaces when gripping the arrow shaft.

5. An arrow guide according to claim 3 further comprising:

a trigger connected to said tynes for manually applying a spreading force to said first arms for releasing the arrow shaft therebetween.

6. An arrow guide according to claim 5 wherein:

said members and said trigger are juxtaposed on the front of the bow.

* * * * *